US006659728B2

(12) United States Patent
Bush et al.

(10) Patent No.: US 6,659,728 B2
(45) Date of Patent: Dec. 9, 2003

(54) LIQUID DISPENSING PUMP SYSTEM

(75) Inventors: Matthew D. Bush, Waterloo, IA (US); Howard E. Koth, Cedar Falls, IA (US); Michael R. Crawford, Cedar Falls, IA (US)

(73) Assignee: Viking Pump, Inc., Cedar Falls, IA (US)

( * ) Notice: Subject to any disclaimer, the term of this patent is extended or adjusted under 35 U.S.C. 154(b) by 26 days.

(21) Appl. No.: 10/035,798

(22) Filed: Nov. 9, 2001

(65) Prior Publication Data

US 2003/0091442 A1 May 15, 2003

(51) Int. Cl.[7] ..... F04B 49/06
(52) U.S. Cl. ..... 417/44.1; 417/410.4; 418/169
(58) Field of Search ..... 417/44.1, 410.4; 418/169, 170, 135

(56) References Cited

U.S. PATENT DOCUMENTS 2,382,539 A * 8/1945 Brady, Jr. ..... 417/410.4
3,374,748 A * 3/1968 Marsh ..... 418/169
4,392,799 A * 7/1983 Shikano et al. ..... 418/169
4,575,313 A * 3/1986 Rao et al. ..... 417/44.1
4,844,297 A * 7/1989 Smith ..... 222/1
5,076,770 A * 12/1991 Dabling et al. ..... 418/135
5,188,523 A * 2/1993 Zatrieb et al. ..... 418/169
5,299,923 A * 4/1994 Arbogast et al. ..... 418/169
6,149,415 A 11/2000 Thompson et al. ..... 418/170

* cited by examiner

*Primary Examiner*—Cheryl J. Tyler
(74) *Attorney, Agent, or Firm*—Marshall, Gerstein & Borun LLP

(57) ABSTRACT

An internal gear pump including a stepper motor coupled to a drive shaft that is coupled to a rotor and meshed with an idler is disclosed. A controller is linked to the stepper motor. The stepper motor imparts a stepped rotational movement to the drive shaft wherein a single 360° rotation of the drive shaft comprises a plurality of steps. The controller sends a signal to the stepper motor to rotate the drive shaft a predetermined number of steps, based upon an inputted dispense amount. The signal causes the stepper motor to rotate the drive shaft a predetermined number of steps. The controller calculates the predetermined number of steps based upon the inputted dispense amount using an algorithm that is derived experimentally that defines a relationship between dispense amount and the number of steps required for each dispense amount. The algorithm is unique for each fluid to be pumped. A head surface area that is planar with the exception of an aperture for receiving the idler pin and a crescent is provided for increased accuracy.

37 Claims, 6 Drawing Sheets

LIQUID DISPENSING PUMP SYSTEM

BACKGROUND

Technical Field

An improved internal gear pump is disclosed. More specifically, one disclosed internal gear pump includes a controller linked to a stepper motor for enhanced dispensing accuracy. Still another disclosed internal gear pump includes an improved head design for enhanced accuracy. Further, algorithms for providing precise pump control and dispensing accuracy are also disclosed.

SUMMARY OF THE INVENTION

Internal gear pumps are known and have long been used for the pumping of thin liquids at relatively high speeds. The typical internal gear pump design includes a rotor mounted to a drive shaft. The rotor includes a plurality of circumferentially disposed and spaced apart rotor teeth that extend axially toward an open end of the pump casing. The open end of the pump casing is typically covered by a head plate or cover plate which, in turn, is connected to an idler. The idler is mounted to the head plate eccentrically with respect to the rotor teeth. The idler also includes a plurality of spaced apart idler teeth disposed between alternating idler roots. The idler teeth are tapered as they extend radially outward and each idler tooth is received between two adjacent rotor teeth. The rotor teeth, in contrast, are tapered as they extend radially inward. A crescent or sealing wall is disposed below the idler and within the rotor teeth. The crescent provides a seal to prevent the loss of fluid disposed between the idler teeth as the idler teeth rotate. The rotor teeth extend below the crescent before rotating around to receive an idler tooth between two adjacent rotor teeth.

The input and output ports for internal gear pumps are disposed on opposing sides of the rotor. The fluid being pumped is primarily carried from the input port to the output port to the space or roots disposed between adjacent idler teeth. This space may be loaded in two ways: radially and axially. The space is loaded radially when fluid passes between adjacent rotor teeth before being received in a root disposed between adjacent idler teeth. Further, there is typically a gap between the distal ends of the rotor teeth and the head plate or casing cover which permits migration of fluid from the inlet port to an area disposed between the head plate and the idler. After migrating into this area, the fluid can be sucked into the area or root disposed between adjacent idler teeth during rotation of the idler and rotor.

In order to increase the speed of such internal gear pumps, head designs have been developed to ensure complete loading of the inner most area between the idler teeth or the root disposed between the adjacent idler teeth. One such design is disclosed in U.S. Pat. No. 6,149,415.

However, while the head design disclosed in the '415 patent and other internal gear pumps known in the art have increased the pumping rate of such internal gear pumps, such designs have been found unsatisfactory for applications where precise dispensing of relatively small amounts of liquids is required.

Accordingly, there is a need for an improved internal gear pump design with improved accuracy.

SUMMARY OF THE DISCLOSURE

Several embodiments of improved internal gear pumps and pumping systems are disclosed which satisfy the aforenoted need.

Specifically, an internal gear pump is disclosed which includes a stepper motor coupled to a drive shaft that, in turn, is coupled to a rotor. The rotor is meshed with an idler which, in turn, is mounted to a head coupled to a head plate. The improvement comprises a controller linked to the stepper motor. The stepper motor imparts a stepped rotational movement to the drive shaft wherein a single 360° rotation of the drive shaft comprises a plurality of steps. The controller sends a signal to the stepper motor to rotate the drive shaft a predetermined number of steps. The signal causes the stepper motor to rotate the drive shaft the predetermined number of steps. The controller calculates the predetermined number of steps based upon a dispensed amount that is inputted to the controller. The controller calculates the predetermined number of steps and generates the signal sent to the stepper motor based upon an algorithm derived experimentally that defines a relationship between dispense amount and a number of steps required for each dispense amount that is unique to each fluid to be pumped.

Typically, the relationship between dispense amount and the number of steps required is a linear relationship that can be defined experimentally with a plurality of data points for a particular liquid. A straight forward algorithm is generated for the liquid to be pumped and stored in the controller memory.

Instead of, or in addition to, the above-described controller system, an improved head design is also disclosed. In the improved head design, the head comprises a head surface that faces towards the rotor. The head surface consists of an aperture for receiving the idler pin, a crescent disposed below the aperture and a remaining planar head surface area that surrounds the aperture and the crescent and that abuttingly engages the rotor and idler. The idler pin extends outward from the aperture in the head surface and the idler comprises a central hole that mateably receives the idler pin so that the idler abuttingly engages a first circular ring area of the head surface disposed above the crescent and around the central aperture. The rotor abuttingly engages a second circular ring area of the head surface area that extends below the crescent and partially overlaps the first circular ring area. The first and second circular ring areas are eccentric with respect to each other and account for the planar head surface area. The terms "above" and "below" are used in a relative sense. In some embodiments, the pump may be arranged where the crescent is disposed vertically above the aperture which accommodates the idler pin. Thus, the first circular ring area extends around the aperture and between the aperture and the crescent. The second circular ring area extends around the crescent wherein the crescent is disposed between the portion of the second circular ring area and the aperture.

In a further refinement, the head and head plate comprises a two-piece assembly wherein a wave spring is disposed between the head and the head plate and the wave spring biases the head towards the rotor.

In another refinement, the head and head plate are unitary in construction.

In a further refinement, the stepper motor is frictionally coupled to the drive shaft which, in turn, is frictionally coupled to the rotor. In a further refinement of this concept, the stepper motor is press fitted to the drive shaft which, in turn, is press fitted to the rotor.

In a further refinement relating to the embodiment including a controller, the controller is linked to a power supply which, in turn, is linked to the stepper motor. The above-described signal is sent from the controller to the power supply which transmits sufficient power to the stepper motor to rotate the drive shaft a predetermined number of steps corresponding to the signal.

In another refinement, each of the above-described steps corresponds to approximately 1.8° of rotation of the drive shaft so that one rotation of the drive shaft is approximately equivalent to 200 steps. In a further refinement, half-steps are available where each half-step corresponds approximately to 0.9° of rotation of the drive shaft so what one rotation of the drive shaft is approximately equal to 400 half-steps. Generally speaking, in depending upon the stepper motor selected, the steps can correspond to a rotation of the drive shaft ranging from about 0.5° to about 3° so that one rotation of the drive shaft can range from about 720 to about 120 steps.

In another refinement, instead of operating based upon an open loop utilizing an algorithm as described above, the controller can operate based upon a closed loop. In such a refinement, the controller is linked either directly or indirectly to an output mechanism which may be in the form of a scale that weighs the fluid being pumped or dispensed from the pump, a fluid level indicator in a receptacle that measures the volume of fluid being pumped or a pressure transducer that measures the pressure or flow rate of the fluid being pumped. The output mechanism generates an output signal which is communicated to the controller. Initially, the controller sends a dispense signal to the stepper motor to rotate the drive shaft. The dispense signal causes the stepper motor to rotate the drive shaft. The controller generates a stop signal and sends a stop signal to the stepper motor based upon an output signal received from the output mechanism that indicates that the dispense amount has been reached.

In yet another refinement, a method for controlling an internal gear pump is disclosed. The method comprises linking a controller to the stepper motor, the controller comprising a memory, deriving an algorithm experimentally that defines a relationship between dispense amount and the number of steps that is unique for each fluid to be pumped, storing the algorithm and the memory of the controller, communicating a dispense amount to the controller, calculating the number of steps in the controller for dispensing the dispense amount using the algorithm and sending a signal from the controller to the stepper motor to rotate the drive shaft the calculated number of steps.

Other features and advantages of the disclosed internal gear pumps, control systems therefore and methods of controlling an internal gear pump will be apparent from the following detailed description and appended claims, and upon reference to the accompanying drawings.

BRIEF DESCRIPTION OF THE DRAWINGS

The disclosed internal gear pump, control system and method of controlling an internal gear pump are illustrated more or less diagrammatically in the following drawings, wherein.

It should be understood that the drawings are not necessarily to scale and that embodiments are sometimes illustrated by graphic symbols, phantom lines, diagrammatic representations and fragmentary views. In certain instances, details which are not necessary for an understanding of the disclosed pumps, control system or control method, or which render other details difficult to perceive, may have been omitted. It should be understood, of course, that the concept disclosed herein are not necessarily limited to the particular embodiments illustrated herein.

DETAILED DESCRIPTION OF THE PRESENTLY PREFERRED EMBODIMENTS

Figure 1:
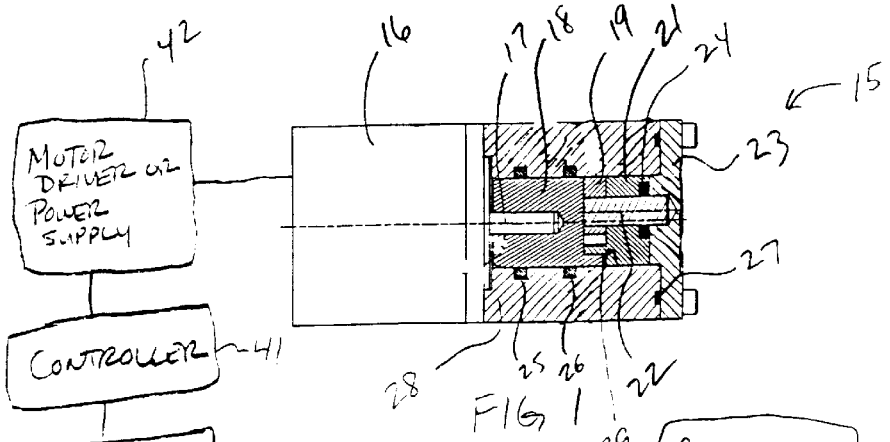
FIG. 1 is a sectional view of one embodiment of an improved internal gear pump linked to a control system.
Figure 2:
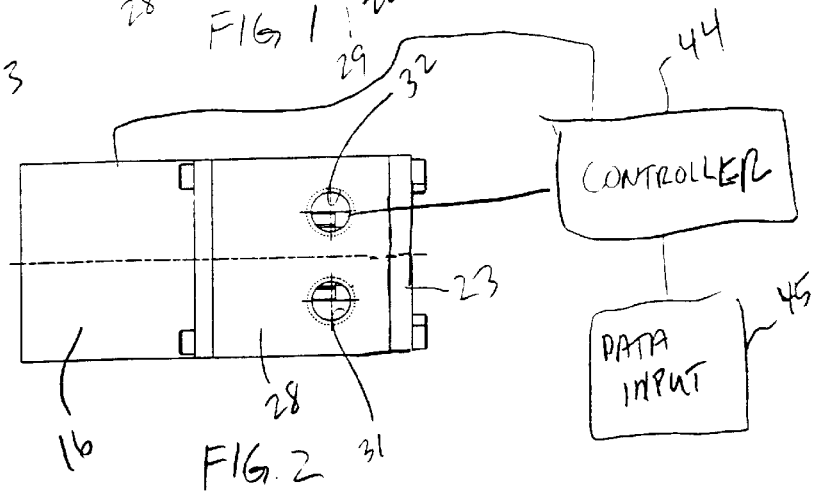
FIG. 2 is a plan view of the pump shown in FIG. 1 schematically illustrating an output port linked to a controller.
Figure 3:
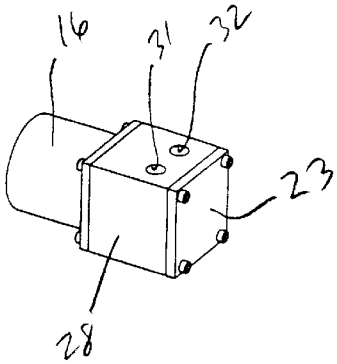
FIG. 3 is a perspective view of the pump shown in FIGS. 1 and 2.
Figure 4:
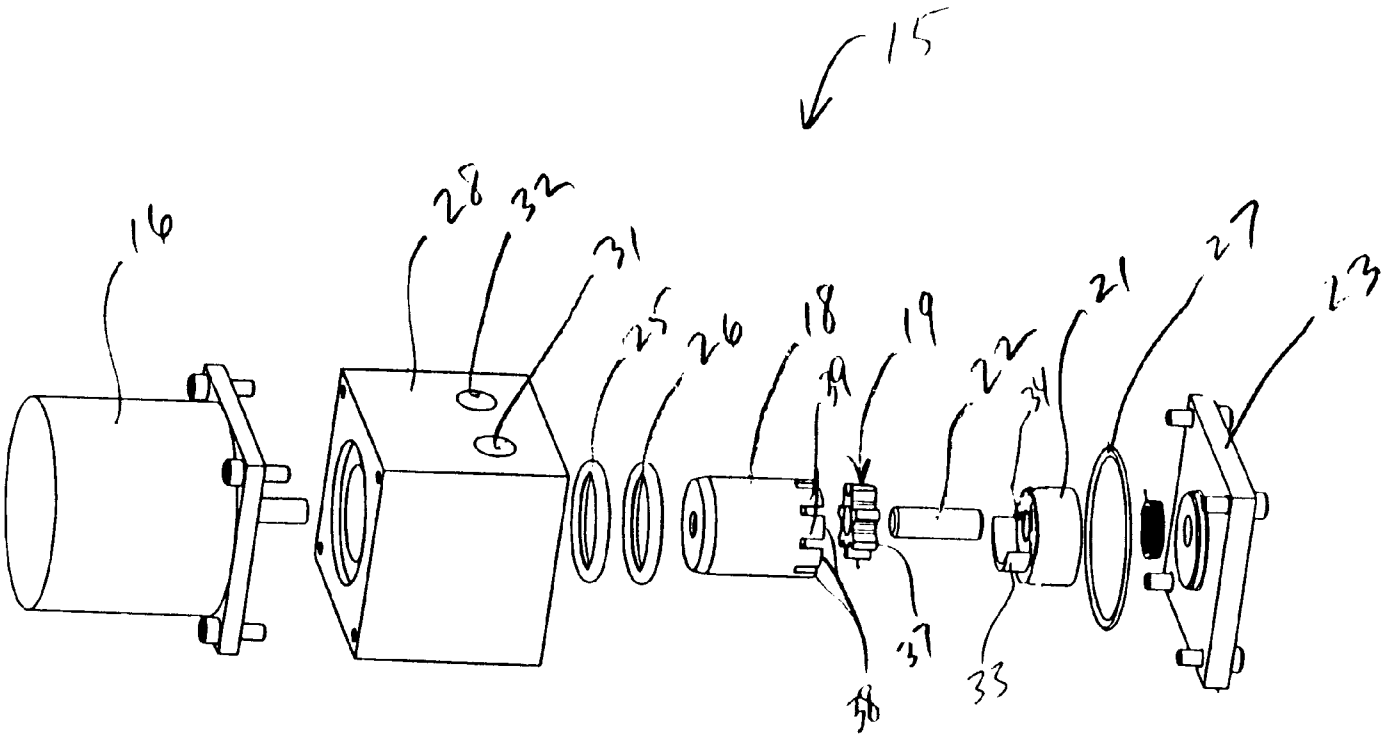
FIG. 4 is an exploded view of the pump shown in FIGS. 1–3.

Turning to FIGS. 1–4, one embodiment of an improved gear pump 15 is disclosed. The pump 15 includes a stepper motor 16 coupled to a drive shaft 17. The drive shaft 17 is received in a rotor 18. The rotor 18 is meshed with an idler 19 that is mounted to a head 21 by way of an idler pin 22. The idler pin extends through the head 21 into the head cover plate 23. The head 21 is biased toward the rotor 18 by a wave spring 24. Seals are illustrated at 25–27. The casing 28 and head plate 23 define a pump chamber 29 which accommodates the rotor 18, idler 19 and head 21. An input port 31 and an output port 32 are shown in FIG. 2. In the internal gear pump design disclosed herein, the input and output ports are interchangeable. Further, one advantage of the disclosed design is that the input and output ports 31, 32 can be disposed in a variety of locations on the casing 28.

Figure 5:
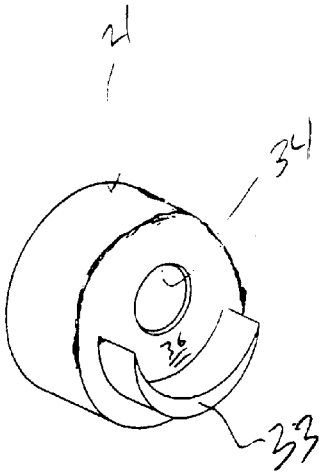
FIG. 5 is a perspective view of the head of the pump illustrated in FIG. 4.

As best seen in FIG. 5, the head 21 includes a crescent 33 and an aperture 34 for accommodating the idler pin 22. Other than the crescent 33 and the aperture 34, the head 21 presents a planar surface area 36 for engaging one side 37 of the idler 19 (see FIG. 4) and the ends 38 of the teeth 39 of the rotor 18 (see also FIG. 4). By presenting a uniform flat planar surface area 36, the head 21 greatly improves the accuracy of the pump 15.

Returning to FIG. 1, the accuracy of the pump 15 is further enhanced by use of a controller 41 to control the action of the stepper motor 16. Specifically, the stepper motor 16 rotates the shaft 17 in a stepped manner whereby a plurality of steps are required to rotate the shaft 17 one rotation or 360°. The size of the steps can vary, depending on the motor 16. In one preferred embodiment, each step is 1.8° so that one complete rotation of the shaft 17 represents 200 steps. In another preferred embodiment, the steps are half this size or half-steps so that each smaller step or half-step is 0.9° of rotation so that one complete rotation of the drive shaft is equivalent to 400 steps. It should be noted that these two step sizes are mere examples and that the step size can range depending upon the accuracy required and the motor 16 selected. For accurate or precise dispensing pumps wherein inaccuracies of 5% or less are desired or inaccuracies within 1%, the step size should be small, ranging from about 0.5° to about 3° so that one rotation of the drive shaft ranges from about 720 steps to about 120 steps.

In the embodiment illustrated in FIG. 1, the controller 41 is linked to a power supply or motor driver 42. The controller sends a signal to the motor driver 42 which supplies the sufficient power to the stepper motor 16 to rotate the shaft 17 the predetermined or requested number of steps. Data may be inputted to the controller 41 directly or through a data input terminal or personal computer or lap-top computer as shown at 43.

Figure 11:
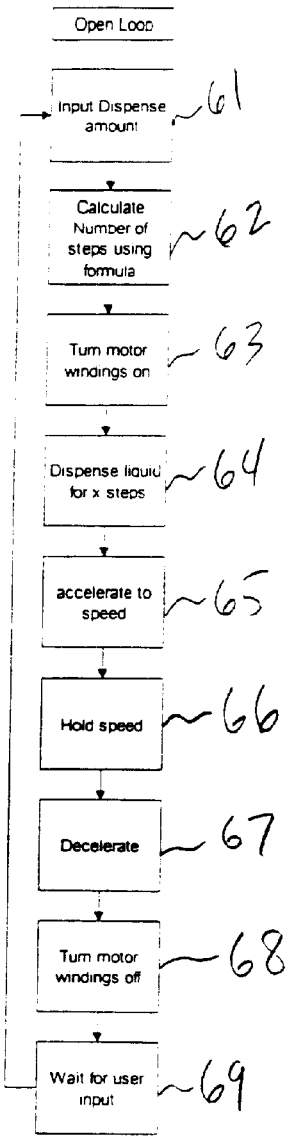
FIG. 11 schematically illustrates an open loop used by the controller shown in FIG. 1.

The algorithms and control methodology utilized by the controller 41 will be discussed below with reference to FIG. 11. Further, the controller 41 or a different controller 44 may be coupled to an output port 32. It will be noted that the controller 41 as shown in FIG. 1 is used to calculate a predetermined number of steps based upon an inputted dispense amount. One open loop algorithm that can be utilized for the controller 41 is illustrated in FIG. 11 and discussed in detail below. In contrast, the controller 44 receives a dispense amount directly or from a data input source 45 and controls the operation of the stepper motor 16 based upon output readings such as the weight of the liquid dispensed, a flow rate reading, a pressure reading or a volume or liquid level reading. One suitable closed loop algorithm that can be utilized by such a controller 44 is discussed below with respect to FIG. 12.

Figure 6:
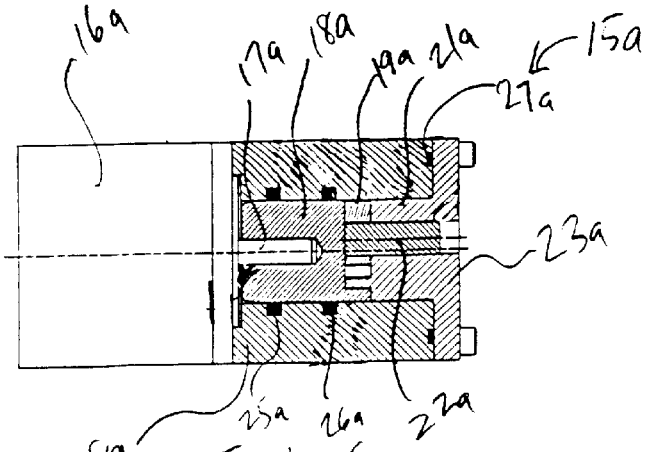
FIG. 6 is a sectional view of another improved internal gear pump.
Figure 8:
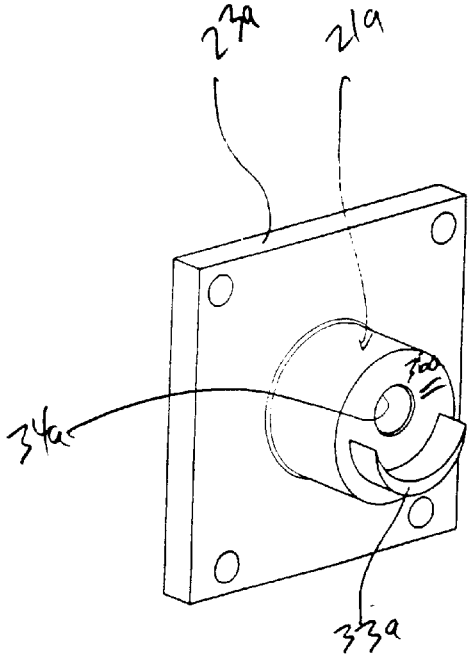
FIG. 8 is a perspective view of the combination head and head plate shown in FIG. 7.
Figure 7:
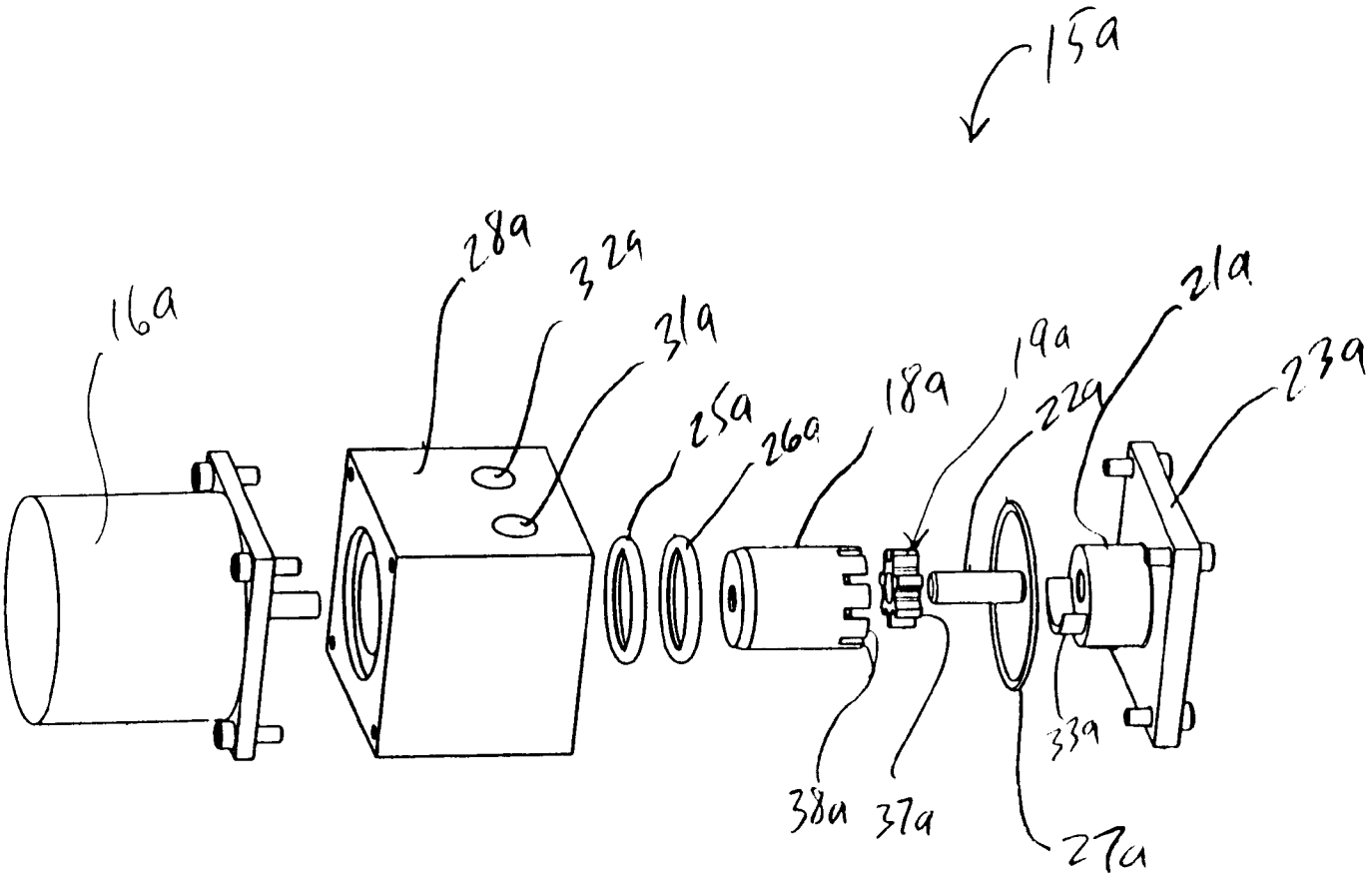
FIG. 7 is an exploded view of the pump shown in FIG. 6.
Figure 10:
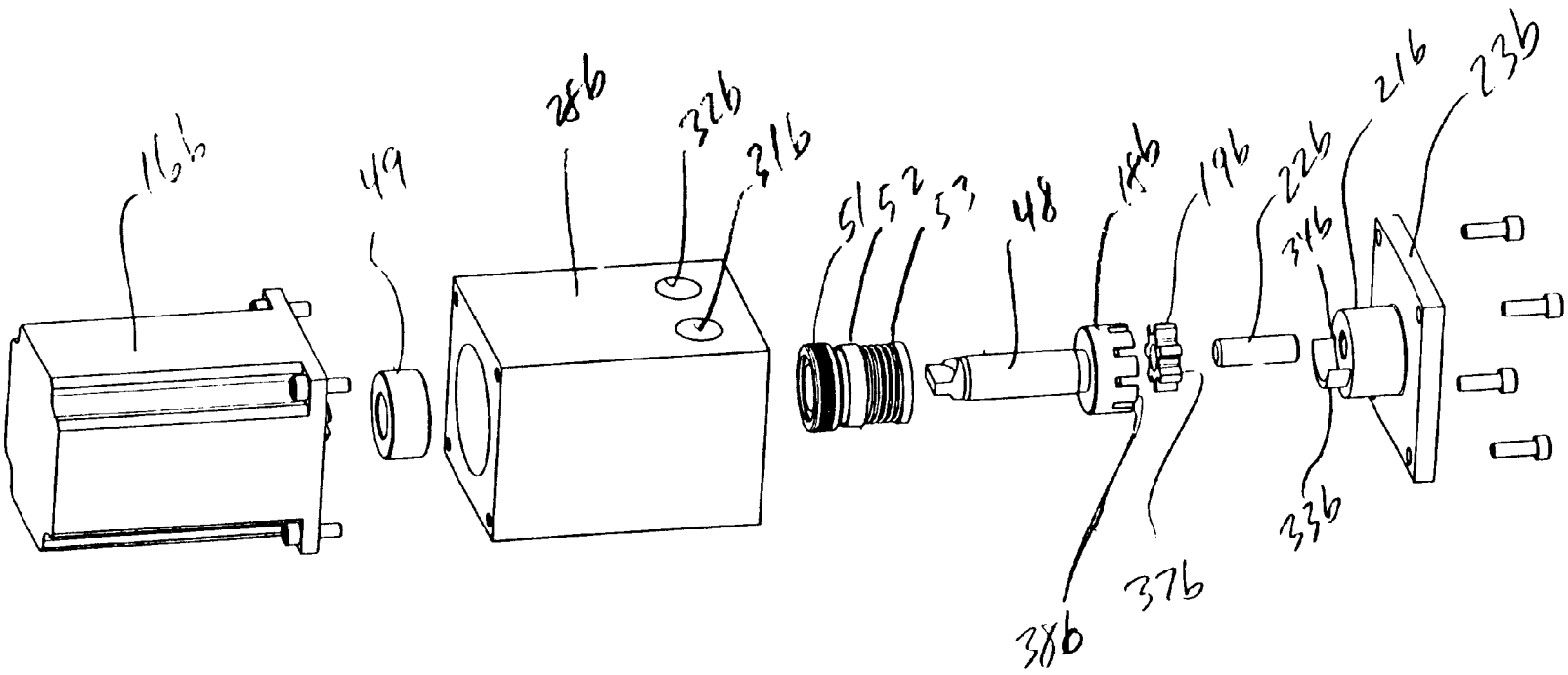
FIG. 10 is an exploded view of the internal gear pump shown in FIG. 9.

Turning to FIGS. 6–8, an alternative pump 15*a* is disclosed. Parts analogous to the pump 15 disclosed in FIGS. 1–5 will be referenced with like reference numerals but with the suffix "a." Like the pump 15, the pump 15*a* includes a stepper motor 16*a* that is coupled to drive shaft 17*a* which, in turn, is coupled to a rotor 18*a*. One preferred coupling method is to use a press-fit connection. The rotor 18*a* is a mesh with an idler 19*a* which, in turn, is trapped between the rotor 18*a*and the head 21*a*. The idler 19*a* is mounted to an idler pin 22*a*. Again, seals are shown at 25–27*a*. Instead of being a separate part from the head plate 23*a*, the head 21*a* and head plate 23*a* are unitary in construction as shown in FIGS. 6–8.

Figure 9:
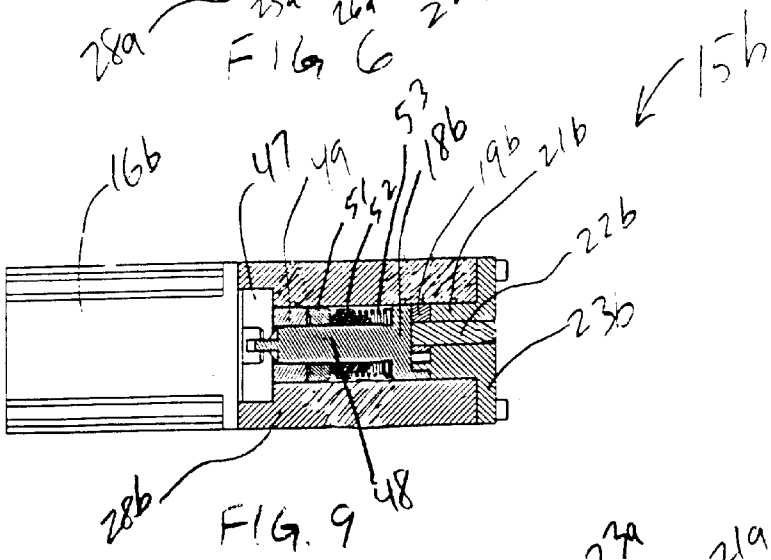
FIG. 9 is a sectional view of another improved internal gear pump.

Referring to FIG. 9, instead of the press-fit between the drive shaft 17, 17*a* and rotors 18, 18*a* as shown in FIGS. 1 and 6 with respect to embodiments 15, 15*a*, the rotor 18*b* is mechanically connected to the stepper motor 16*b* by way of the coupling 47. Instead of a drive shaft 17 or 17*a*, the rotor 18*b* includes its own shaft section 48. The bushing 49 and mechanical seals 51–53 are utilized instead of the o-ring seals 25–25*a* and 26, 26*a* as described above. Again, the head 21*b* and head plate cover 23*b* are unitary in construction similar to the embodiment 15*a* discussed above.

Figure 12:
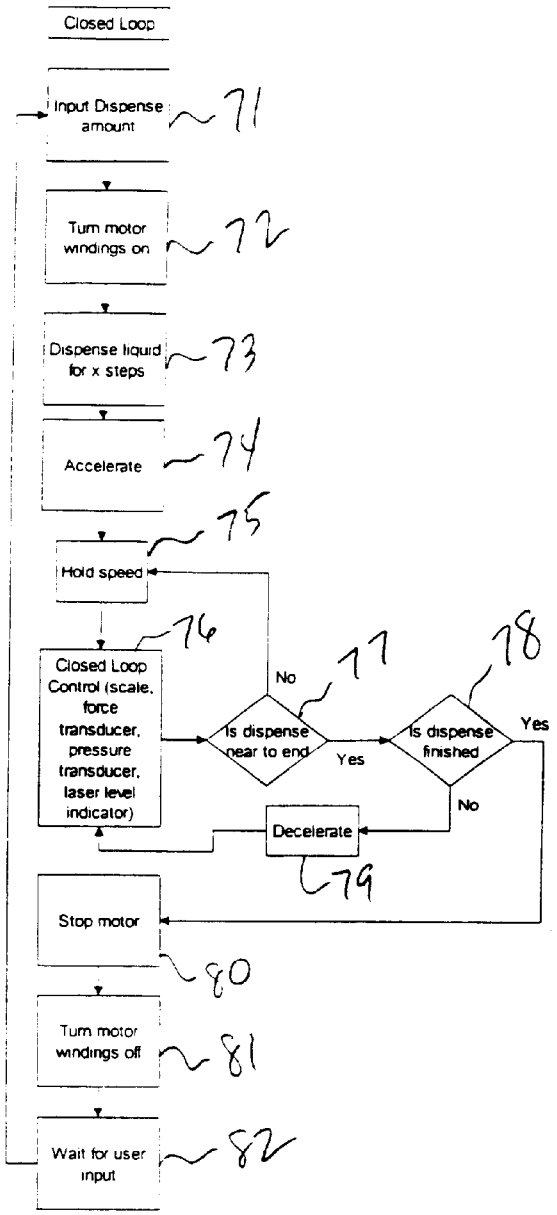
FIG. 12 schematically illustrates a closed loop that can be used by the controller shown in FIG. 2.

Turning to FIGS. 11 and 12, algorithms for use by a controller 41 based upon input data (see FIG. 1) or controller 44 based upon output data (see FIG. 2) are illustrated respectively.

FIG. 11 discloses an open-loop control process wherein at step 61, a dispense amount is inputted to the controller 41 either directly or through a data input terminal such as a personal computer or lap-top computer 43. Using an algorithm programmed into its memory, the controller 41 calculates the number of steps required to dispense the amount inputted with the pump 15, 15*a* or 15*b*. The algorithm is generated from experimental test results wherein a plurality of data points are generated for a plurality of dispense amounts in corresponding steps. It has been found with the pump designs 15, 15*a* and 15*b* and variations thereof that the relationship between dispense amount and number of steps is generally linear. Accordingly, a trend line is developed with a slope. For example, the dispense amount y may be related to the number of steps x by way of the formula: $y=mx+b$ wherein b is a y-axis intersect value. Accordingly, the controller 41 calculates the number of steps required for pumping the dispense amount at 62. At step 63, the controller 41 either directly activates the stepper motor 16, 16*a* or 16*b* or activates the stepper motor 16, 16*a*, 16*b* through a power supply or motor driver 42. To dispense the liquid for the predetermined number of steps at step 64, the controller, either directly or through the power supply 42 accelerates the motor to an operating speed at step 65, holds the speed at step 66, decelerates the motor at step 67 and deactivates the motor at step 68 after the drive shaft 17, 17*a* or rotor 18*b* has been rotated the appropriate amount corresponding to the predetermined number of steps calculated at step 62. The controller then awaits for additional dispense amount input at steps 69.

It will be noted that steps 63–68 may be combined into a single step or divided further into additional individual steps, depending upon the controller 41 design, power supply 42 design and stepper motor 16, 16*a*, 16*b* design.

Referring to FIG. 12, a closed loop control system is illustrated schematically that is based upon an output signal. At step 71, a dispense amount is inputted to the controller 44 either directly or through a data input terminal 45 as described above. The controller 44 activates the stepper motor 16, 16*a*, or 16*b* at step 72. The dispensing begins at step 73 where, at step 74, the motor is accelerated to operating speed and maintained at that speed at step 75. At this point, output signals are generated at step 76 and communicated back to the controller 44. The output signals may be generated by a scale that weighs the amount of fluid dispensed, a flow meter that measures the amount of fluid dispensed, a pressure transducer that measures the pressure of the liquid being dispensed, or a level indicator which communicates to the controller the level of liquid in a container of a known volume thereby enabling the controller to generate the volume of liquid dispensed. If the amount of liquid dispensed is close to the inputted dispensed amount at 77, the controller then checks again to see if the dispense amount has been reached at 78 and, if not, the stepper motor 16, 16*a* or 16*b* is decelerated at 79 before the closed loop represented by steps 76–79 is repeated. If the dispensed amount has been reached at step 78, the motor is stopped at 80 and shut down at 81 before the controller 44 awaits for additional input at 82.

Obviously, variations of the open loop and closed loop methodologies described in FIGS. 11 and 12 will be apparent to those skilled in the art. The use of these methodologies with and without the pump design refinements above lead to an improved accuracy for internal gear pump operation.

From the above description, it is apparent that the deficiencies of the prior art have been overcome. While only certain embodiments have been set forth and described, other alternative embodiments and various modifications will be apparent from the above description to those skilled in the art. These and other alternatives are considered equivalents and within the spirit and scope of the present disclosure.

What is claimed:

1. An internal gear pump including a stepper motor coupled to a drive shaft that is coupled to a rotor meshed with an idler mounted to a head coupled to a head plate, the improvement comprising:

a controller linked to the stepper motor, the stepper motor imparting a stepped rotational movement to the drive shaft wherein a single 360° rotation of the drive shaft comprises a plurality of steps, the controller sending a signal to the stepper motor to rotate the drive shaft a predetermined number of steps, the signal causing the stepper motor to rotate the drive shaft the predetermined number of steps, the controller calculating the predetermined number of steps based upon an inputted dispense amount, the controller calculating the predetermined number of steps and generating the signal sent to the stepper motor based upon an algorithm derived experimentally that defines a relationship between dispense amount and a number of steps required for each dispense amount that is unique for each fluid to be pumped, and a wave spring disposed between the head and the head plate, the wave spring biasing the head towards the rotor.

2. The internal gear pump of claim 1 wherein the head and head plate are unitary in construction.

3. The internal gear pump of claim 1 wherein the pump further comprises the stepper motor frictionally coupled to the drive shaft that is frictionally coupled to the rotor.

4. The internal gear pump of claim 1 wherein the head comprises a head surface that faces towards the rotor, the head surface consisting of an aperture for receiving an idler pin, a crescent disposed below the aperture and a remaining planar head surface area that surrounds the aperture and the crescent and that abuttingly engages the rotor and the idler, the idler pin extending outward from the aperture of the head surface, the idler comprising a central hole that mateably receives the idler pin so that the idler abuttingly engages a first circular ring area of the head surface area disposed above the crescent and around the central aperture, the rotor abuttingly engaging a second circular ring area of the head surface area that extends below the crescent and partially overlaps the first circular ring area, the first and second circular ring areas being eccentric with respect to each other.

5. The internal gear pump of claim 1 wherein each step corresponds to approximately 1.8° of rotation of the drive shaft so that one rotation of the drive shaft is approximately equivalent to 200 steps.

6. The internal gear pump of claim 1 wherein each step corresponds to approximately 0.9° of rotation of the drive shaft so that one rotation of the drive shaft is approximately equivalent to 400 steps.

7. The internal gear pump of claim 1 wherein each step corresponds to a rotation of the drive shaft ranging from about 0.5° to 3° about so that one rotation of the drive shaft ranges from about 720 to about 120 steps.

8. The internal gear pump of claim 1 wherein the stepper motor that is press fitted to a drive shaft that is press fitted to the rotor.

9. An internal gear pump including a stepper motor coupled to a drive shaft that is coupled to a rotor meshed with an idler mounted to a head coupled to a head plate, the improvement comprising:

a controller linked to the stepper motor, the stepper motor imparting a stepped rotational movement to the drive shaft wherein a single 360° rotation of the drive shaft comprises a plurality of steps, the controller sending a signal to the stepper motor to rotate the drive shaft a predetermined number of steps, the signal causing the stepper motor to rotate the drive shaft the predetermined number of steps, the controller calculating the predetermined number of steps based upon an inputted dispense amount, the controller calculating the predetermined number of steps and generating the signal sent to the stepper motor based upon an algorithm derived experimentally that defines a relationship between dispense amount and a number of steps required for each dispense amount that is unique for each fluid to be pumped, and wherein the relationship is a linear relationship generated from an experimentally generated trend line.

10. An internal gear pump including a stepper motor coupled to a drive shaft that is coupled to a rotor meshed with an idler mounted to a head coupled to a head plate, the improvement comprising:

a controller linked to the stepper motor, the stepper motor imparting a stepped rotational movement to the drive shaft wherein a single 360° rotation of the drive shaft comprises a plurality of steps, the controller sending a signal to the stepper motor to rotate the drive shaft a predetermined number of steps, the signal causing the stepper motor to rotate the drive shaft the predetermined number of steps, the controller calculating the predetermined number of steps based upon an inputted dispense amount, the controller calculating the predetermined number of steps and generating the signal sent to the stepper motor based upon an algorithm derived experimentally that defines a relationship between dispense amount and a number of steps required for each dispense amount that is unique for each fluid to be pumped, and wherein the controller is linked to a power supply which is linked to the stepper motor and the signal is sent from the controller to the power supply which transmits sufficient power to the stepper motor to rotate the drive shaft the predetermined number of steps corresponding to the signal.

11. An internal gear pump including a rotor, an idler and an idler pin disposed inside a pump chamber defined by a casing having an open end covered by a head plate, the improvement comprising:

a head coupled to the head plate, the head comprising a head surface that faces towards the rotor, the head surface consisting of an aperture for receiving the idler pin, a crescent disposed below the aperture and a remaining planar head surface area that surrounds the aperture and the crescent and that abuttingly engages the rotor and the idler, the idler pin extending outward from the aperture of the head surface, the idler comprising a central hole that mateably receives the idler pin so that the idler abuttingly engages a first circular ring area of the head surface area disposed above the crescent and around the central aperture, the rotor abuttingly engaging a second circular ring area of the head surface area that extends below the crescent and partially overlaps the first circular ring area, the first and second circular areas being eccentric with respect to each other, and a wave spring disposed between the head and head plate, the wave spring biasing the head towards the rotor.

12. The internal gear pump of claim 11 wherein the head and head plate are unitary in construction.

13. The internal gear pump of claim 11 wherein the pump further comprises a stepper motor coupled to a drive shaft that is coupled to the rotor.

14. The internal gear pump of claim 13 further comprising a controller linked to the stepper motor, the stepper motor imparting a stepped rotational movement to the drive shaft wherein a single rotation of the drive shaft comprises a plurality of steps, the controller sending a signal to the stepper motor to rotate the drive shaft a predetermined number of steps, the signal causing the stepper motor to rotate the drive shaft the predetermined number of steps, the controller calculating the predetermined number of steps corresponding to the signal sent to the stepper motor based upon an algorithm derived experimentally that defines a relationship between dispense amount and a number of steps required for the dispense amount that is unique for each fluid to be pumped.

15. The internal gear pump of claim 14 wherein each step corresponds to approximately 1.8° of rotation of the drive shaft so that one rotation of the drive shaft is approximately equivalent to 200 steps.

16. The internal gear pump of claim 14 wherein each step corresponds to approximately 0.9° of rotation of the drive shaft so that one rotation of the drive shaft is approximately equivalent to 400 steps.

17. The internal gear pump of claim 14 wherein each step corresponds to a rotation of the drive shaft ranging from about 0.5° to 3° about so that one rotation of the drive shaft ranges from about 720 to about 120 steps.

18. The internal gear pump of claim 11 further comprising a controller linked to the stepper motor, the controller being linked to an output mechanism selected from the group consisting of a scale that weighs the fluid being pumped, a fluid level indicator that measures the volume of fluid being pumped, a flow meter that measures the flow rate of the fluid being pumped, and a pressure transducer that measures the pressure of the liquid being pumped, the output mechanism generating an output signal which is communicated to the controller, the controller sending a dispense signal to the stepper motor to rotate the drive shaft, the dispense signal causing the stepper motor to rotate the drive shaft, the controller generating a stop signal and sending the stop signal to the stepper motor based upon the output signal received from the output mechanism.

19. The internal gear pump of claim 11 wherein the pump further comprises a stepper motor that is press fitted to a drive shaft that is press fitted to the rotor.

20. An internal gear pump including a rotor, an idler and an idler pin disposed inside a pump chamber defined by a casing having an open end covered by a head plate, the improvement comprising:

a head coupled to the head plate, the head comprising a head surface that faces towards the rotor, the head surface consisting of an aperture for receiving the idler pin, a crescent disposed below the aperture and a remaining planar head surface area that surrounds the aperture and the crescent and that abuttingly engages the rotor and the idler, the idler pin extending outward from the aperture of the head surface, the idler comprising a central hole that mateably receives the idler pin so that the idler abuttingly engages a first circular ring area of the head surface area disposed above the crescent and around the central aperture, the rotor abuttingly engaging a second circular ring area of the head surface area that extends below the crescent and partially overlaps the first circular ring area, the first and second circular areas being eccentric with respect to each other, and wherein the relationship is a linear relationship generated from an experimentally generated trend line.

21. An internal gear pump including a rotor, an idler and an idler pin disposed inside a pump chamber defined by a casing having an open end covered by a head plate, the improvement comprising:

a head coupled to the head plate, the head comprising a head surface that faces towards the rotor, the head surface consisting of an aperture for receiving the idler pin, a crescent disposed below the aperture and a remaining planar head surface area that surrounds the aperture and the crescent and that abuttingly engages the rotor and the idler, the idler pin extending outward from the aperture of the head surface, the idler comprising a central hole that mateably receives the idler pin so that the idler abuttingly engages a first circular ring area of the head surface area disposed above the crescent and around the central aperture, the rotor abuttingly engaging a second circular ring area of the head surface area that extends below the crescent and partially overlaps the first circular ring area, the first and second circular areas being eccentric with respect to each other, and wherein the controller is linked to a power supply which is linked to the stepper motor and the signal is sent from the controller to the power supply which transmits sufficient power to the stepper motor to rotate the drive shaft the predetermined number of steps that corresponds with the signal.

22. An internal gear pump comprising:

a stepper motor coupled to a drive shaft that is coupled to a rotor, the rotor extending into a pump chamber defined by a casing having an open end covered by a head plate, the pump further comprising an idler and an idler pin disposed inside a pump chamber, a head coupled to the head plate, the head comprising a head surface that faces towards the rotor, the head surface consisting of an aperture for receiving the idler pin, a crescent disposed below the aperture and a remaining planar head surface area that surrounds the aperture and the crescent and that abuttingly engages the rotor and the idler, the idler pin extending outward from the aperture of the head surface, the idler comprising a central hole that mateably receives the idler pin so that the idler abuttingly engages a first circular ring area of the head surface area disposed above the crescent and around the central aperture, the rotor abuttingly engaging a second circular ring area of the head surface area that extends below the crescent and partially overlaps the first circular ring area, the first and second circular areas being eccentric with respect to each other, the pump further comprising a stepper motor frictionally coupled to a drive shaft that is frictionally coupled to the rotor, the stepper motor being linked to a controller, the stepper motor imparting a stepped rotational movement to the drive shaft wherein a single rotation of the drive shaft comprises a plurality of steps, the controller sending a signal to the stepper motor to rotate the drive shaft a predetermined number of steps, the signal causing the stepper motor to rotate the drive shaft the predetermined number of steps, the controller calculating the predetermined number of steps corresponding to the signal sent to the stepper motor based upon an algorithm derived experimentally that defines a relationship between dispense amount and a number of steps required for the dispense amount that is unique for each fluid to be pumped, wherein the relationship is a linear relationship generated from an experimentally generated trend line.

23. The internal gear pump of claim 22 wherein each step corresponds to approximately 1.8° of rotation of the drive shaft so that one rotation of the drive shaft is approximately equivalent to 200 steps.

24. The internal gear pump of claim 22 wherein each step corresponds to approximately 0.9° of rotation of the drive shaft so that one rotation of the drive shaft is approximately equivalent to 400 steps.

25. The internal gear pump of claim 22 wherein each step corresponds to a rotation of the drive shaft ranging from about 0.5° to 3° about so that one rotation of the drive shaft ranges from about 720 to about 120 steps.

26. The internal gear pump of claim 22 wherein the head and head plate are unitary in construction.

27. An internal gear pump comprising:

a stepper motor coupled to a drive shaft that is coupled to a rotor, the rotor extending into a pump chamber defined by a casing having an open end covered by a head plate, the pump further comprising an idler and an idler pin disposed inside a pump chamber, a head coupled to the head plate, the head comprising a head surface that faces towards the rotor, the head surface consisting of an aperture for receiving the idler pin, a crescent disposed below the aperture and a remaining planar head surface area that surrounds the aperture and the crescent and that abuttingly engages the rotor and the idler, the idler pin extending outward from the aperture of the head surface, the idler comprising a central hole that mateably receives the idler pin so that the idler abuttingly engages a first circular ring area of the head surface area disposed above the crescent and around the central aperture, the rotor abuttingly engaging a second circular ring area of the head surface area that extends below the crescent and partially overlaps the first circular ring area, the first and second circular areas being eccentric with respect to each other, the pump further comprising a stepper motor frictionally coupled to a drive shaft that is frictionally coupled to the rotor, the stepper motor being linked to a controller, the stepper motor imparting a stepped rotational movement to the drive shaft wherein a single rotation of the drive shaft comprises a plurality of steps, the controller sending a signal to the stepper motor to rotate the drive shaft a predetermined number of steps, the signal causing the stepper motor to rotate the drive shaft the predetermined number of steps, the controller calculating the predetermined number of steps corresponding to the signal sent to the stepper motor based upon an algorithm derived experimentally that defines a relationship between dispense amount and a number of steps required for the dispense amount that is unique for each fluid to be pumped, wherein the controller is linked to a power supply which is linked to the stepper motor and the signal is sent to the power supply which transmits sufficient power to the stepper motor to rotate the drive shaft the predetermined number of steps that corresponds with the signal.

28. An internal gear pump comprising:

a stepper motor coupled to a drive shaft that is coupled to a rotor, the rotor extending into a pump chamber defined by a casing having an open end covered by a head plate, the pump further comprising an idler and an idler pin disposed inside a pump chamber, a head coupled to the head plate, the head comprising a head surface that faces towards the rotor, the head surface consisting of an aperture for receiving the idler pin, a crescent disposed below the aperture and a remaining planar head surface area that surrounds the aperture and the crescent and that abuttingly engages the rotor and the idler, the idler pin extending outward from the aperture of the head surface, the idler comprising a central hole that mateably receives the idler pin so that the idler abuttingly engages a first circular ring area of the head surface area disposed above the crescent and around the central aperture, the rotor abuttingly engaging a second circular ring area of the head surface area that extends below the crescent and partially overlaps the first circular ring area, the first and second circular areas being eccentric with respect to each other, the pump further comprising a stepper motor frictionally coupled to a drive shaft that is frictionally coupled to the rotor, the stepper motor being linked to a controller, the stepper motor imparting a stepped rotational movement to the drive shaft wherein a single rotation of the drive shaft comprises a plurality of steps, the controller sending a signal to the stepper motor to rotate the drive shaft a predetermined number of steps, the signal causing the stepper motor to rotate the drive shaft the predetermined number of steps, the controller calculating the predetermined number of steps corresponding to the signal sent to the stepper motor based upon an algorithm derived experimentally that defines a relationship between dispense amount and a number of steps required for the dispense amount that is unique for each fluid to be pumped, wherein the controller is linked to a personal computer which transmits the inputted dispense amount to the controller.

29. A control system for an internal gear pump comprising a stepper motor coupled to a drive shaft that is coupled to a rotor, the stepper motor imparting a stepped rotational movement to the drive shaft wherein a single rotation of the drive shaft comprises a plurality of steps, the control system comprising:

a controller linked to the stepper motor, the stepper motor imparting a stepped rotational movement to the drive shaft wherein a single 360° rotation of the drive shaft comprises a plurality of steps, the controller sending a signal to the stepper motor to rotate the drive shaft a predetermined number of steps, the signal causing the stepper motor to rotate the drive shaft the predetermined number of steps, the controller calculating the predetermined number of steps based upon an inputted dispense amount, the controller calculating the predetermined number of steps and generating the signal sent to the stepper motor based upon an algorithm derived experimentally that defines a relationship between dispense amount and a number of steps required for each dispense amount that is unique for each fluid to be pumped, wherein the relationship is a linear relationship generated from an experimentally generated trend line.

30. The control system of claim 29 wherein each step corresponds to approximately 1.8° of rotation of the drive shaft so that one rotation of the drive shaft is approximately equivalent to 200 steps.

31. The control system of claim 29 wherein each step corresponds to approximately 0.9° of rotation of the drive shaft so that one rotation of the drive shaft is approximately equivalent to 400 steps.

32. The control system of claim 29 wherein each step corresponds to a rotation of the drive shaft ranging from about 0.5° to 3° about so that one rotation of the drive shaft ranges from about 720 to about 120 steps.

33. A control system for an internal gear pump comprising a stepper motor coupled to a drive shaft that is coupled to a rotor, the stepper motor imparting a stepped rotational movement to the drive shaft wherein a single rotation of the drive shaft comprises a plurality of steps, the control system comprising:

a controller linked to the stepper motor, the stepper motor imparting a stepped rotational movement to the drive shaft wherein a single 360° rotation of the drive shaft comprises a plurality of steps, the controller sending a signal to the stepper motor to rotate the drive shaft a predetermined number of steps, the signal causing the stepper motor to rotate the drive shaft the predetermined number of steps, the controller calculating the predetermined number of steps based upon an inputted dispense amount, the controller calculating the predetermined number of steps and generating the signal sent to the stepper motor based upon an algorithm derived experimentally that defines a relationship between dispense amount and a number of steps required for each dispense amount that is unique for each fluid to be pumped, wherein the controller is linked to a power supply which is linked to the stepper motor and the signal is sent to the power supply which transmits sufficient power to the stepper motor to rotate the drive shaft the predetermined number of steps that corresponds with the signal.

34. A method for controlling an internal gear pump comprising an internal gear pump comprising a stepper motor coupled to a drive shaft that is coupled to a rotor, the stepper motor imparting a stepped rotational movement to the drive shaft wherein a single rotation of the drive shaft comprises a plurality of steps, the method comprising:

linking a controller linked to the stepper motor, the controller comprising a memory, deriving an algorithm experimentally that defines a relationship between dispense amount and the number of steps that is unique for each fluid to be pumped, storing the algorithm in the memory of the controller, communicating a dispense amount to the controller, calculating the number of steps in the controller for dispensing the dispense amount using the algorithm, sending a signal from the controller to the stepper motor to rotate the drive shaft the calculated number of steps, wherein the relationship is a linear relationship generated from an experimentally generated trend line.

35. The method of claim 34 wherein each step corresponds to approximately 1.8° of rotation of the drive shaft so that one rotation of the drive shaft is approximately equivalent to 200 steps.

36. The method of claim 34 wherein each step corresponds to approximately 0.9° of rotation of the drive shaft so that one rotation of the drive shaft is approximately equivalent to 400 steps.

37. The method of claim 34 wherein each step corresponds to a rotation of the drive shaft ranging from about 0.5° to 3° about so that one rotation of the drive shaft ranges from about 720 to about 120 steps.

* * * * *